US010520236B2

(12) United States Patent
Tarr et al.

(10) Patent No.: US 10,520,236 B2
(45) Date of Patent: Dec. 31, 2019

(54) OFF-TIME DETECTOR FOR STAND-ALONE ICE MAKING APPLIANCES

(71) Applicant: Haier US Appliance Solutions, Inc., Wilmington, DE (US)

(72) Inventors: Ronald Scott Tarr, Louisville, KY (US); Yan Bo, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/687,584

(22) Filed: Aug. 28, 2017

(65) Prior Publication Data

US 2018/0080698 A1 Mar. 22, 2018

(30) Foreign Application Priority Data

Sep. 20, 2016 (CN) ..... 2016 1 0833720

(51) Int. Cl.
*F25C 1/14* (2018.01)
*F25C 1/147* (2018.01)

(52) U.S. Cl.
CPC ..... *F25C 1/147* (2013.01); *F25B 2600/23* (2013.01); *F25C 2600/02* (2013.01); *F25C 2600/04* (2013.01)

(58) Field of Classification Search
CPC .. F25C 1/147; F25C 2400/14; F25C 2600/02; F25C 2600/04; F25B 2600/23; H02H 3/06
See application file for complete search history.

(56) References Cited

U.S. PATENT DOCUMENTS 3,619,668 A * 11/1971 Pinckaers ..... H02H 3/06 307/141
4,573,325 A 3/1986 Chiu et al.
4,622,826 A 11/1986 Tsukiyama et al.
5,455,469 A * 10/1995 Ward ..... H02H 3/06 307/141.4
5,524,448 A 6/1996 Schwanebeck et al.
5,684,342 A * 11/1997 Innes ..... H02H 6/005 307/117
2003/0010054 A1* 1/2003 Esch ..... A47F 3/0439 62/354
2011/0041542 A1* 2/2011 Brunner ..... F25C 1/147 62/344

* cited by examiner

*Primary Examiner* — Eric S Ruppert
(74) *Attorney, Agent, or Firm* — Dority & Manning, P.A.

(57) ABSTRACT

Stand-alone ice making appliances and methods of controlling stand-alone ice making appliances are provided. An appliance includes a container defining a first storage volume for receipt of ice, a water tank defining a second storage volume for receipt of water, and a pump in fluid communication with the second storage volume. The appliance further includes an ice maker which is in fluid communication with the pump for receiving water from the pump. The appliance further includes an off-time detector configured to provide a signal indicative of whether the ice maker has been unpowered for a time period sufficient to begin ice production without overheating.

10 Claims, 7 Drawing Sheets

OFF-TIME DETECTOR FOR STAND-ALONE ICE MAKING APPLIANCES

FIELD OF THE INVENTION

The present subject matter relates generally to stand-alone ice making appliances, and in exemplary embodiments to stand-alone ice making appliances which produce nugget ice and which utilize an off-time detector to prevent overheating of the ice making appliance.

BACKGROUND OF THE INVENTION

Ice makers generally produce ice for the use of consumers, such as in drinks being consumed, for cooling foods or drinks to be consumed and/or for other various purposes. Certain refrigerator appliances include ice makers for producing ice. The ice maker can be positioned within the appliances' freezer chamber and direct ice into an ice bucket where it can be stored within the freezer chamber. Such refrigerator appliances can also include a dispensing system for assisting a user with accessing ice produced by the refrigerator appliances' ice maker. However, the incorporation of ice makers into refrigerator appliance can have drawbacks, such as limits on the amount of ice that can be produced and the reliance on the refrigeration system of the refrigerator appliance to form the ice.

Recently, stand-alone ice makers have been developed. These ice makers are separate from refrigerator appliances and provide independent ice supplies, and may be capable of being moved from place to place. Many stand-alone ice makers utilize a sealed refrigeration system to produce ice, which can include a compressor. In order to move a stand-alone ice maker, consumers may need to unpower the stand-alone ice maker. If the compressor has previously built up an appropriate operating pressure differential, the compressor motor may not be able to overcome the pressure differential when the stand-alone ice maker is repowered, which can cause the compressor to stall and overheat. A safety device may then be triggered, preventing the ice maker from making ice for a long period of time, such as half an hour to an hour. A delay in starting the compressor when the stand-alone ice maker is first powered can allow for the pressure differential to be reduced, thereby preventing overheating of the compressor, but this will delay the time to first ice, leading to potential customer frustration. Further, typical stand-alone ice makers are expensive, to the point of being cost-prohibitive to the typical consumer.

Accordingly, improved stand-alone ice makers are desired in the art. In particular, cost-effective stand-alone ice makers which decrease the time to first ice while preventing a compressor from overheating would be advantageous.

BRIEF DESCRIPTION OF THE INVENTION

Aspects and advantages of the invention will be set forth in part in the following description, or may be apparent from the description, or may be learned through practice of the invention.

One example aspect of the present disclosure is directed to a stand-alone ice making appliance. The stand-alone ice making appliance can include a container defining a first storage volume for receipt of ice. The stand-alone ice making appliance can also include a water tank. The water tank can define a second storage volume for receipt of water. The stand-alone ice making appliance can also include a pump in fluid communication with the second storage volume for actively flowing water from the water tank. The stand-alone ice making appliance can also include an ice maker. The ice maker can be in fluid communication with the pump for receiving water from the pump. The stand-alone ice making appliance can also include an off-time detector provide a signal indicative of whether the ice maker has been unpowered for a time period sufficient to begin ice production without overheating.

Another example aspect of the present disclosure is directed to a method of controlling a stand-alone ice making appliance. The ice making appliance can include an ice maker. The method can include receiving, by one or more controllers, a request to make ice. The method can also include receiving, by the one or more controllers, a signal indicative of whether the ice maker has been unpowered for a time period sufficient to produce ice without overheating. The method can also include determining, by the one or more controllers, whether the ice maker has been unpowered for the time period sufficient to begin ice production without overheating based at least upon the signal. The method can also include activating, by the one or more controllers, the ice maker to begin ice production when the ice maker has been unpowered for the time period sufficient to begin ice production without overheating.

Another example aspect of the present disclosure is directed to a stand-alone ice making appliance. The stand-alone ice making appliance can include a removable container defining a first storage volume for receipt of ice. The stand-alone ice making appliance can also include a water tank. The water tank can define a second storage volume for receipt of water and disposed below the container along a vertical direction. The stand-alone ice making appliance can also include a pump in fluid communication with the second storage volume for actively flowing water from the water tank. The stand-alone ice making appliance can also include a reservoir defining a third storage volume. The third storage volume can be in fluid communication with the pump for receiving water that is actively flowed from the water tank. The stand-alone ice making appliance can also include an ice maker. The ice maker can include a sealed refrigeration system. The sealed refrigeration system can include a compressor. The stand-alone ice making appliance can also include a chute extending between the ice maker and the container for directing ice produced by the ice maker towards the first storage volume. The stand-alone ice making appliance can also include an off-time detector configured to provide a signal indicative of whether the ice maker has been unpowered for a time period sufficient to begin ice production without overheating. The stand-alone ice making appliance can also include a controller configured to control the ice maker. The controller can further be configured to receive the signal from the off-time detector. The ice within the first storage volume can be maintained at a temperature greater than thirty-two degrees Fahrenheit.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
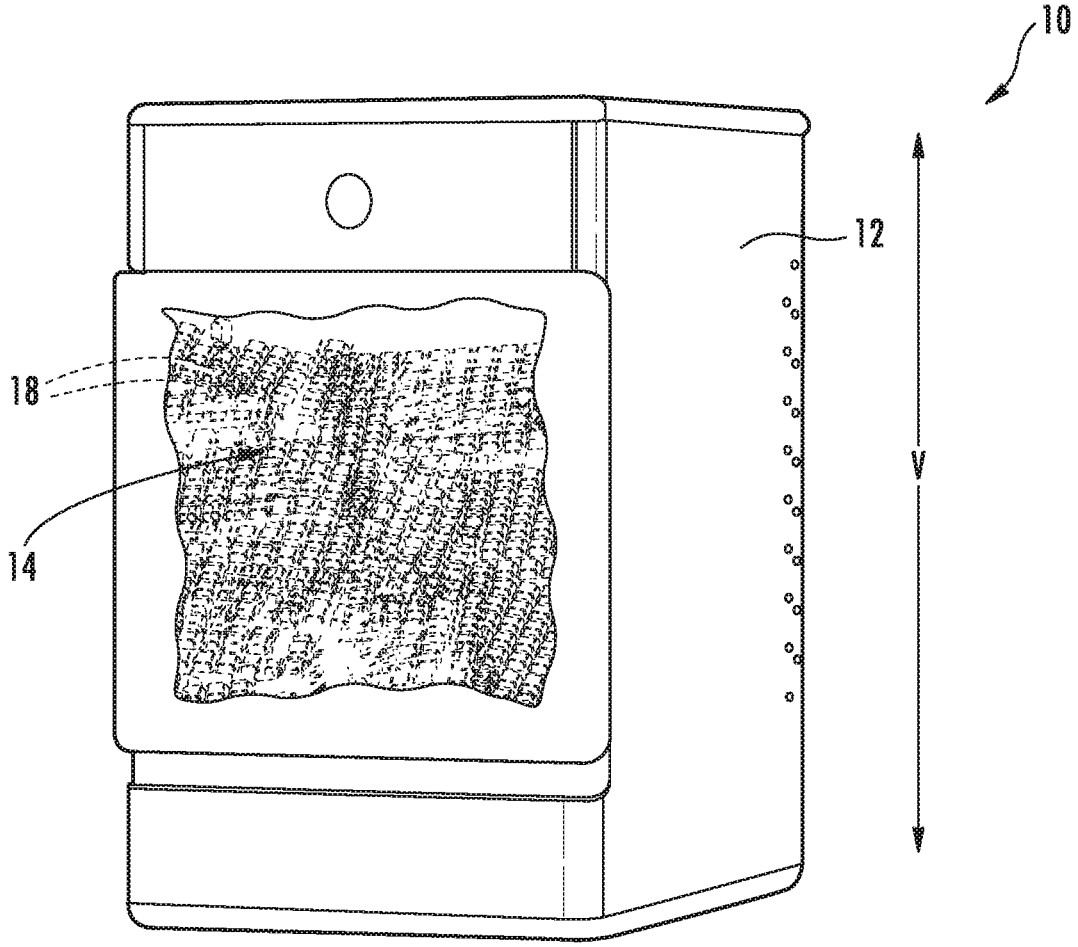
FIG. 1 is a perspective view of a stand-alone ice making appliance according to example embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Example aspects of the present disclosure are directed to a stand-alone ice making appliance. Stand-alone ice makers can be used separately from refrigerator appliances to provide independent ice supplies, and can be sized so that they can be placed, for example, on a countertop. Stand-alone ice makers can include a compressor as part of a sealed refrigeration system used to make ice. If the compressor has previously built up an appropriate operating pressure differential in the system and then is stopped, this pressure differential may not immediately subside. If the compressor is restarted at this point, the compressor motor may not be able to overcome this pressure differential, which can cause the motor to stall and overheat. The motor may have a safety device attached to it in order prevent it from overheating. The safety device may stop the motor from operating until the safety device detects that the motor has cooled down. The motor may then be restarted, allowing ice making to occur. However, this process can take a significant amount of time, such as upwards of 30 minutes to an hour.

Alternatively, if the compressor is not restarted for a sufficient period of time after it is powered down, for example, approximately 3 minutes for many compressors, the pressure differential will have decreased, thereby allowing the compressor to be restarted without overheating the compressor motor. A typical solution therefore is to include a delay in compressor start-up in the software of the product such that if at any time the compressor is shut off, it cannot be restarted for a predetermined period of time such as, for example, 3 minutes.

However, if the unit is unplugged, for example, to move the ice making appliance from place to place, the control system may be powered down and may not know how long the compressor has been unpowered. A typical solution is to simply not start the compressor for a predetermined period of time every time the unit is powered up. However this will increase the time to first ice, which can cause consumer frustration. Accordingly, not applying a delay at startup will improve the time to first ice.

In the situation where a consumer unpowers the ice making appliance and repowers it before the compressor pressure differential has subsided, the consumer likely desires to continue making ice. However, if the compressor pressure differential has not subsided and the ice making appliance does know how long it has been off, the control system may restart the compressor, potentially overheating the compressor, leading to a delay of up to an hour for the compressor to cool down.

Example aspects of the present disclosure are directed to an ice making appliance including an off-time detector and associated method, which can allow a quick start and also prevent compressor overheating. According to example aspects of the present disclosure, the off-time detector can be a parallel connected resistor and capacitor that is designed to have a discharge time that is sufficient to allow the compressor differential to subside, thereby preventing overheating. While the compressor is powered, the capacitor can be charged. When the compressor is unpowered, the capacitor can discharge stored charge through the resistor. When the unit is powered back on, the off-time detector can be used to determine whether the compressor has been unpowered for a sufficient time to begin ice production without overheating. For example, in an embodiment, a controller can be used to check if the capacitor has discharged substantially all of its stored charge. If the capacitor has discharged substantially all charge, the controller can activate the ice maker to begin ice production. In an embodiment, if the capacitor has not discharged all charge, the controller can wait a predetermined time period before beginning ice production. In another embodiment, if the capacitor has not discharged all charge, the controller can wait until all charge has been discharged before beginning ice production.

In this way, the ice making appliances and method according to example aspects of the present disclosure can have the technical effect of decreasing the time to first ice for an ice making appliance, while preventing a compressor in an ice making appliance from overheating. This can lead to decreased consumer frustration and increased ice production over a set period of time.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

Referring now to FIG. 1, a stand-alone ice making appliance 10 in accordance with example aspects of the present disclosure is illustrated. As shown, appliance 10 includes an outer casing 12 which generally at least partially houses various other components of the appliance therein 10. A container 14 is also illustrated. Container 14 defines a first storage volume 16 for the receipt and storage of ice 18 therein. A user of the appliance 10 may access ice 18 within the container 14 for consumption or other uses. Container 14 may include one or more sidewalls 20 and a base wall 22 (see FIG. 2), which may together define the first storage volume 16. In exemplary embodiments, at least one sidewall 20 may be formed from a clear, see-through (i.e. transparent or translucent) material, such as a clear glass or plastic, such that a user can see into the first storage volume 16 and thus view ice 18 therein. Further, according to example aspects of the present disclosure, container 14 may be removable, such as from the outer casing 12, by a user. This facilitates easy access by the user to ice within the container 14 and further, for example, may provide access to a water tank 24 (see FIG. 2) of the appliance 10.

Appliances 10 according to example aspects of the present disclosure are advantageously stand-alone appliances, and thus are not connected to refrigerators or other appliances. Additionally, in an example embodiment, such appliances are non-plumbed, and thus not connected to plumbing or another water source that is external to the appliance 10, such as a refrigerator water source. Rather, in an example embodiment, water is initially supplied to the appliance 10 manually by a user, such as by pouring water into water tank 24.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. The removable container 14 allows easy access to ice and allows the container 14 to be moved to a different position from the remainder of the appliance 10 for ice usage purposes. Additionally, in example embodiments as discussed herein, appliance 10 is configured to make nugget ice (as discussed herein) which is becoming increasingly popular with consumers.

Referring to FIGS. 2 through 5, various other components of appliances 10 in accordance with example aspects of the present disclosure are illustrated. For example, as mentioned, appliance 10 includes a water tank 24. The water tank 24 defines a second storage volume 26 for the receipt and holding of water. Water tank 24 may include one or more sidewalls 28 and a base wall 30 which may together define the second storage volume 26. In an example embodiment, the water tank 24 may be disposed below the container 14 along a vertical direction V defined for the appliance 10, as shown.

Figure 2:
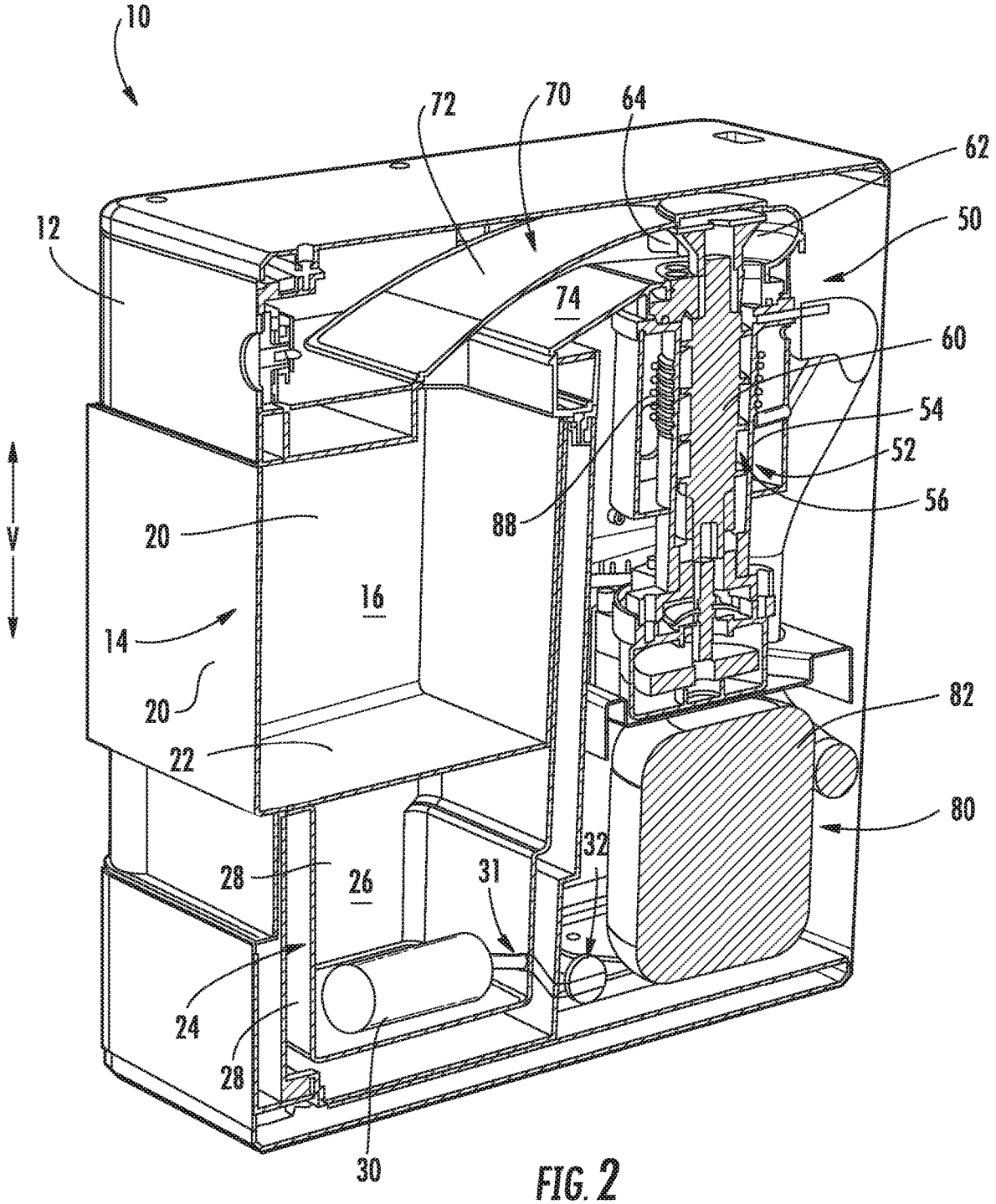
FIG. 2 is a perspective sectional view of a stand-alone ice making appliance according to example embodiments of the present subject matter.
Figure 3:
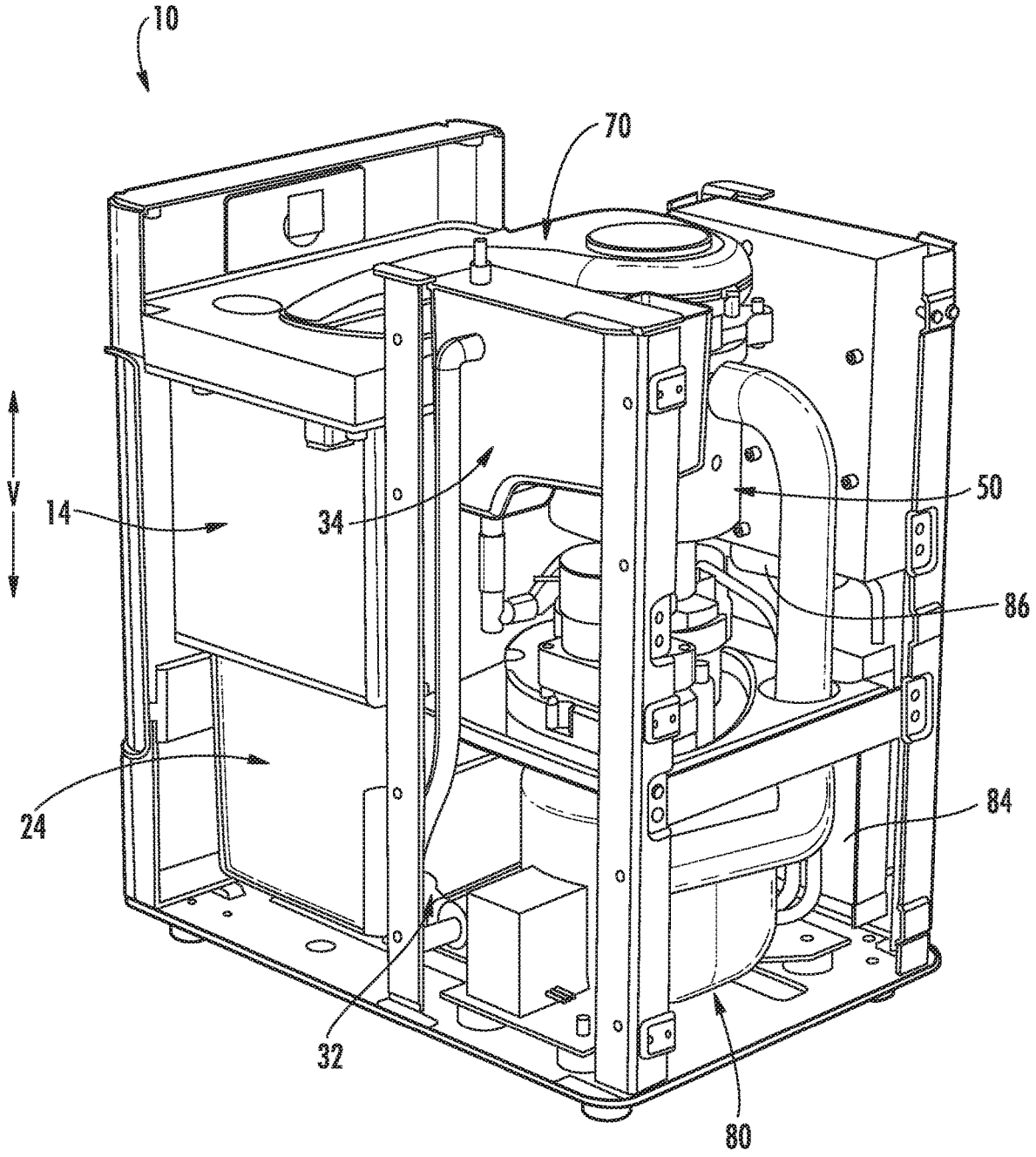
FIG. 3 is a rear perspective view (with a casing removed) of a stand-alone ice making appliance according to example embodiments of the present subject matter.
Figure 4:
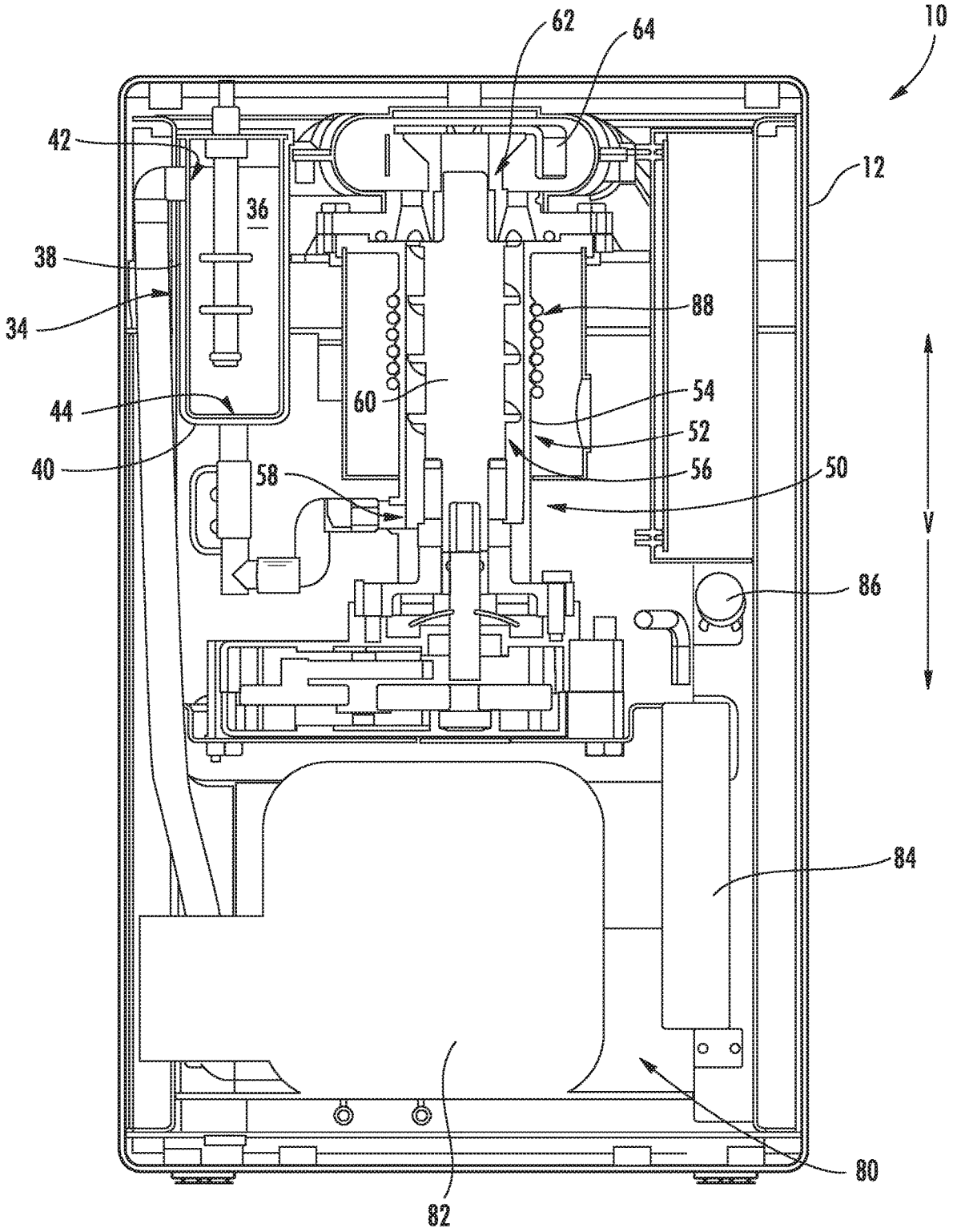
FIG. 4 is a rear sectional view of a stand-alone ice making appliance according to example embodiments of the present subject matter.

As discussed, in an example embodiment, water is provided to the water tank 24 for use in forming ice. Accordingly, appliance 10 may further include a pump 32. Pump 32 may be in fluid communication with the second storage volume 26. For example, water may be flowable from the second storage volume 26 through an opening 31 defined in the water tank 24, such as in a sidewall 28 thereof, and may flow through a conduit to and through pump 32. Pump 32 may, when activated, actively flow water from the second storage volume 26 therethrough and from the pump 32. In an example embodiment, a filter 150 operable to remove contaminants from water flowing through the filter 150 may be positioned upstream of the ice maker 50 in a flow direction of water from the second storage volume 26 to the ice maker 50, as shown in FIG. 2.

Water actively flowed from the pump 32 may be flowed (for example through a suitable conduit) to ice maker 50. For example, in some embodiments water actively flowed from the pump 32 may be flowed (for example through a suitable conduit) directly to the ice maker 50. Alternatively, an intermediate reservoir 34 may be provided, and water may be actively flowed from the pump 32 to the reservoir 34. For example, reservoir 34 may define a third storage volume 36, which may be defined by one or more sidewalls 38 and a base wall 40. Third storage volume 36 may, for example, be in fluid communication with the pump 32 and may thus receive water that is actively flowed from the water tank 24, such as through the pump 32. For example, water may be flowed into the third storage volume 36 through an opening 42 defined in the reservoir 34.

Reservoir 34 and third storage volume 36 thereof may receive and contain water to be provided to an ice maker 50 for the production of ice. Accordingly, third storage volume 36 may be in fluid communication with ice maker 50. For example, water may be flowed, such as through opening 44 and through suitable conduits, from third storage volume 36 to ice maker 50.

Ice maker 50 generally receives water, such as from reservoir, and freezes the water to form ice 18. The ice maker 50 is in fluid communication with the pump 32, such as directly or indirectly via reservoir 34 and third storage volume 36. While any suitable style of ice maker is within the scope and spirit of the present disclosure, in an example embodiment, ice maker 50 is a nugget ice maker, and in particular is an auger-style ice maker. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening 58 may be defined in a sidewall 54. Water may be flowed from third storage volume 36 through the opening 58 (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in an example embodiment, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provide to the container 14. In an example embodiment, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72 which defines a passage 74 therethrough. Ice 18 may be directed from the ice maker 50 (such as from the auger 60 and/or extruder 62) through the passage 74 to the container 14. In some embodiments, for example, a sweep 64, which may for example be connected to and rotate with the auger, may contact the ice emerging through the extruder 62 from the auger 60 and direct the ice through the passage 74 to the container 14.

As discussed, water within the casing 52 may at least partially freeze due to heat exchange, such as with a refrigeration system. In an example embodiment, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86 and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof. During operation of sealed system 80, refrigerant exits evaporator 88 as a fluid in the form of a superheated vapor and/or vapor mixture. Upon exiting evaporator 88, the refrigerant enters compressor 82 wherein the pressure and temperature of the refrigerant are increased such that the refrigerant becomes a superheated vapor. The superheated vapor from compressor 82 enters condenser 84 wherein energy is transferred therefrom and condenses into a saturated liquid and/or liquid vapor mixture. This fluid exits condenser 84 and travels through throttling device 86 that is configured for regulating a flow rate of refrigerant therethrough. Upon exiting throttling device 86, the pressure and temperature of the refrigerant drop at which time the refrigerant enters evaporator 88 and the cycle repeats itself. In certain exemplary embodiments, as illustrated in FIG. 5, throttling device 86 may be a capillary tube.

As discussed, in an example embodiment, ice 18 may be nugget ice. Nugget ice is ice that that is maintained or stored (i.e. in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than 60 degrees Fahrenheit.

Ice 18 held within the first storage volume 16 may gradually melt. The melting speed is increased for nugget ice due to the increased maintenance/storage temperature. Accordingly, drain features may advantageously be provided in the container for draining such melt water. Additionally, and advantageously, the melt water may in exemplary embodiments be reused by appliance 10 to form ice.

Figure 5:
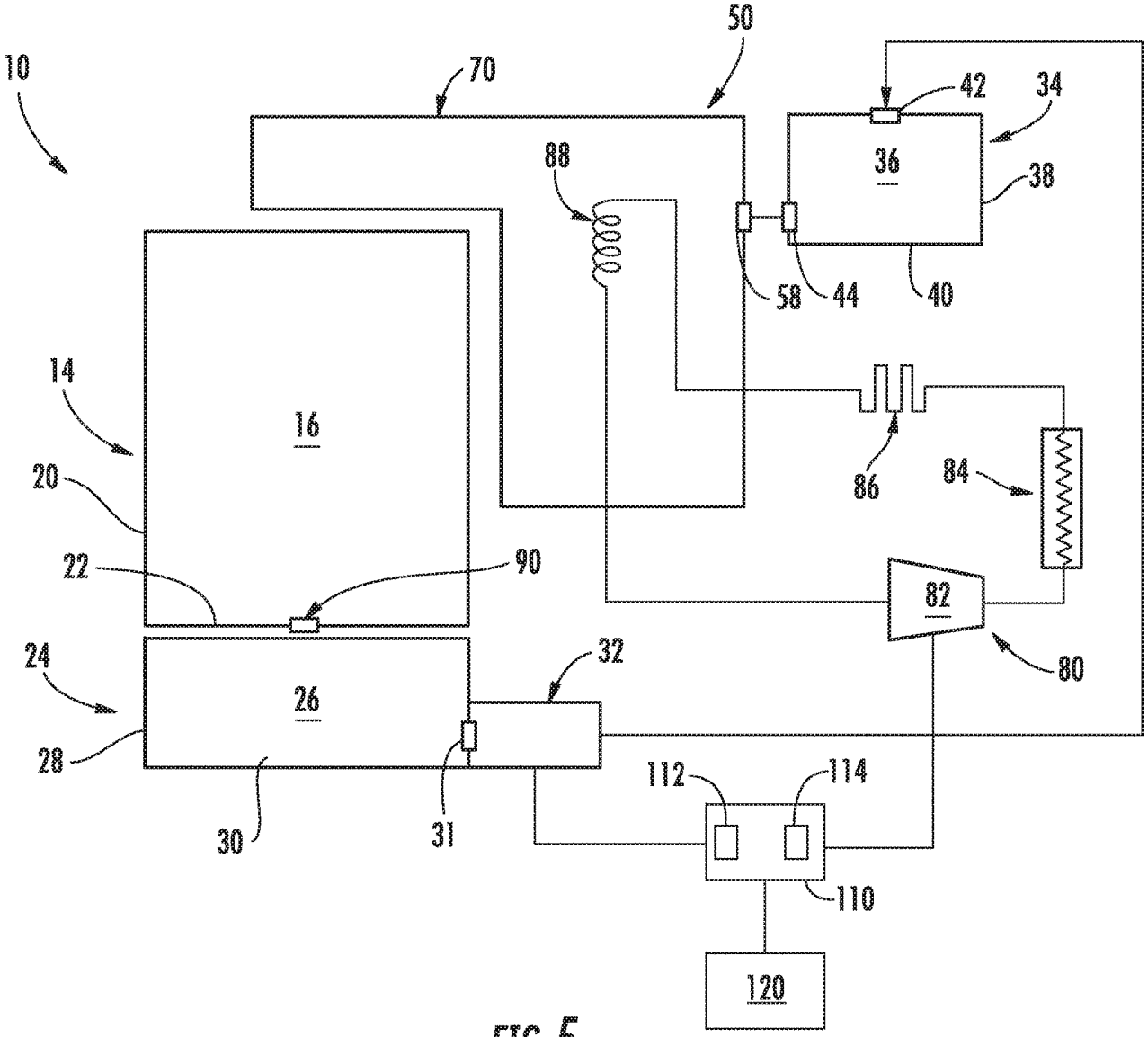
FIG. 5 is a schematic diagram of a stand-alone ice making appliance according to example embodiments of the present subject matter.

For example, in some embodiments as illustrated in FIG. 5, a drain aperture 90 may be defined in the base wall 22. Drain aperture 90 may allow water to flow from the first storage volume 16 and container 14 generally. Further, in an example embodiment, water flowing from the first storage volume 16 and container 14 may, due to gravity and the vertical alignment of the container 14 of water tank 24, flow into the second storage volume 26.

In an example embodiment, appliance 10 may further include a controller 110. Controller 110 may, for example, be configured to operate the appliance 10 based on, for example, user inputs to the appliance 10 (such as to a user interface thereof), inputs from various sensors disposed within the appliance 10, and/or other suitable inputs. Controller 110 may for example include one or more memory devices 112 and one or more processors 114, such as general or special purpose microprocessors operable to execute programming instructions or micro-control code associated with appliance 10 operation. The memory devices 112 may represent random access memory such as DRAM, or read only memory such as ROM or FLASH. In one embodiment, the one or more processors 114 executes programming instructions stored in the one or more memory devices 112. The one or more memory devices 112 may be a separate component from the one or more processors 114 or may be included onboard within the one or more processors 114.

In an example embodiment, controller 110 may be in operative communication with the pump 32. Such operative communication may be via a wired or wireless connection, and may facilitate the transmittal and/or receipt of signals by the controller 110 and pump 32. Controller 110 may be configured to activate the pump 32 to actively flow water. For example, controller 110 may activate the pump 32 to actively flow water therethrough when, for example, reservoir 34 requires water. A suitable sensor(s), for example, may be provided in the third storage volume 36. The sensor(s) may be in operative communication with the controller 110 may be transmit signals to the controller 110 which indicate whether or not additional water is desired in the reservoir 34. When controller 110 receives a signal that water is desired, controller 110 may send a signal to pump 32 to activate that pump.

In an example embodiment, controller 110 may be in operative communication with an off-time detector 120, and may be configured to receive one or more signals from off-time detector 120. As will be discussed in greater detail with respect to FIG. 6, off-time detector 120 can be configured to determine whether the ice maker has been unpowered for a sufficient time to begin ice production without overheating. It should additionally be noted that, in an example embodiment, controller 110 may be in operative communication with the sealed system 80 of ice maker 50, such as with the compressor 82 thereof, and may activate the sealed system 80 as desired or required for ice making purposes. Further, in an embodiment, off-time detector 120 can be included in sealed system 80 such that off-time detector 120 is provided electrical power when sealed system 80 is in operation.

Figure 6:
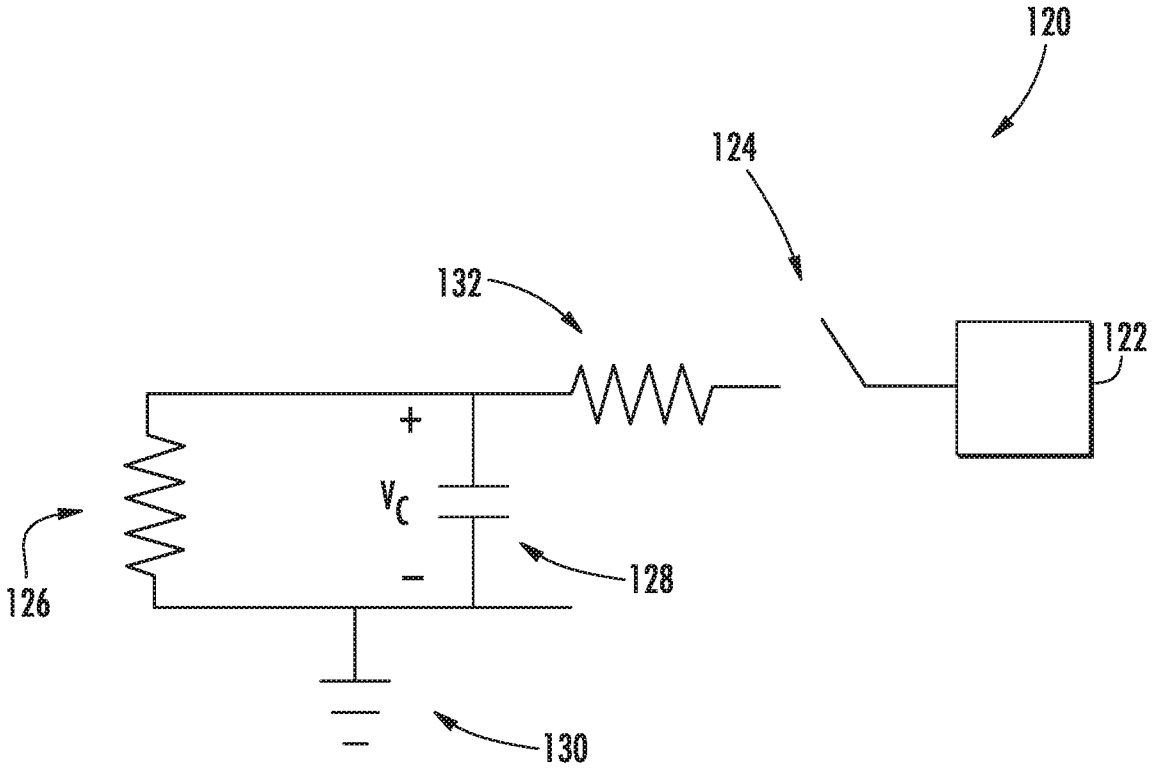
FIG. 6 is a schematic diagram of an off-time detector according to example embodiments of the present subject matter.

Referring now to FIG. 6, an off-time detector 120 according to example aspects of the present disclosure is shown. As shown, off-time detector 120 can include a first resistor 126 and a capacitor 128 connected in parallel, and further connected to a ground 130. As shown in FIG. 6, a second resistor 132 can also be included in off-time detector 120. Second resistor 132 can be connected in series with the first resistor 126 and capacitor 128 between a switch 124 and the parallel connected first resistor 126 and capacitor 128. Other configurations of an off-time detector can be used without departing from the spirit or scope of the present disclosure. A voltage source 122 can be electrically connected to second resistor 132, first resistor 126, and capacitor 128 by switch 124. In an embodiment, voltage source 122 can be an independent voltage source, such as a power supply for an appliance 10. In another embodiment, voltage source 122 can be a controller 110 configured to provide electrical power to an off-time detector 124. Additionally, in an embodiment, voltage source 122 can be electrically connected to a common ground, such as to ground 130.

In an embodiment, switch 124 can be configured to be controlled by controller 110. For example, switch 124 can be closed by controller 110 when controller 110 sends a signal to sealed system 80 to begin ice production. Additionally, switch 124 can be opened by controller 110 when controller 110 sends a signal to sealed system 80 to cease ice production. When switch 124 is closed, such as, for example, when controller 110 closes switch 124, voltage source 122 will apply a voltage across second resistor 132, such that an electrical current will flow through second resistor 132 to first resistor 126 and capacitor 128. Over time, as electrical current flows through second resistor 132, capacitor 128 will accumulate charge. As charge accumulates in capacitor 128, the voltage across capacitor 128 (Vc) will increase until the voltage of capacitor 128 (Vc) reaches the voltage provided by voltage source 122, at which time the electric current will stop flowing through second resistor 132. When switch 124 is opened, such as, for example, when controller 110 opens switch 124, stored charge in capacitor 128 can discharge through first resistor 126 to ground 130. Additionally, in an embodiment, switch 124 can be configured to automatically open when power to the ice maker 50 is lost, such as when the ice making appliance 10 is unpowered.

According to example aspects of the present disclosure, off time detector 120 can be configured to provide a signal indicative of whether the ice maker 50 has been unpowered for a time period sufficient to begin ice production without overheating. For example, ice maker 50 can include a compressor 82. During operation, a compressor 82 will build up an appropriate operating pressure differential. If the ice maker 50 is unpowered, such as, for example, if a consumer were to unplug the ice making appliance to relocate the ice making appliance, and then repower the ice making appliance by plugging it back in shortly thereafter, the pressure differential in compressor 82 may not have reduced to the point where a motor in compressor 82 can overcome the pressure differential. In this case, compressor 82 may stall and overheat, thereby triggering a safety device in compressor 82 to shut down the motor in compressor 82 until it has sufficiently cooled down, which can take upwards of thirty minutes to an hour. As used herein, the term "overheat" refers to the process of a safety device, such as a safety device on a compressor 82, being triggered during the operation of an ice maker, such as an ice maker 50, such that safety device stops operation of the ice maker until the ice maker has cooled down to a sufficiently low temperature to resume operation. However, if the compressor 82 is not restarted for a sufficient period of time after it is powered down, the pressure differential will have decreased, thereby allowing the compressor to be restarted without overheating the compressor 82. For example, in an embodiment, a compressor 82 in an ice maker 50 may be configured to begin ice production without overheating when it has been unpowered for approximately three minutes. As used herein, the term "approximately" when used in connection with a numerical value is intended to refer to within 20% of the stated numerical value.

According to example aspects of the present disclosure, an off-time detector 120 can be configured such that a switch 124 is closed when the ice maker 50 is powered, thereby charging capacitor 128 when the ice maker 50 is powered. When ice maker 50 is unpowered, switch 124 can be opened, such that stored charge in capacitor 128 can discharge through first resistor 126. In an embodiment, off-time detector 120 can be configured such that capacitor 128 will discharge substantially all stored charge in the time it takes for the operational pressure differential of a compressor, such as compressor 82, to reduce to a level such that the compressor 82 will not overheat when the compressor 82 is powered. As used herein, the phrase "substantially all" when used in reference to the charge level of a capacitor means at least 80% of the stored charge capacity of the capacitor.

For example, a compressor 82 can be configured such that it will not overheat when it has been unpowered for approximately three minutes. According to an embodiment, an off-time detector 120 can be configured to discharge substantially all stored charge after approximately three minutes. For example, a capacitor 128 can have a capacitance of approximately 180 microfarads, a first resistor 126 can have a resistance of approximately 600 kiloohms, and a second resistor 132 can have a resistance of approximately 100 ohms. In such a configuration, an off-time detector 120 can be configured to charge capacitor 128 to a full charge in less than a second and further discharge substantially all stored charge in capacitor 128 after approximately three minutes. Further, an off-time detector 120 can be configured to provide a signal indicative of whether an ice maker 50 has been unpowered for a time period sufficient to begin ice production without overheating based at least upon a charge level of the capacitor 128. For example, a charge level of a capacitor 128 can be determined based at least in part on a voltage across the capacitor 128 (Vc). As stored charge in a capacitor 128 is discharged through first resistor 126, the voltage across the capacitor 128 (Vc) will decrease. In an embodiment, the signal from an off-time detector 120 indicative of whether an ice maker 50 has been unpowered for a time period sufficient to begin ice production without overheating can be a voltage across the capacitor 128. In this way, an off-time detector 120 can be configured to provide a signal indicative of whether an ice maker 50 has been unpowered for a time period sufficient to begin ice production without overheating based on a charge level of capacitor 128.

Furthermore, in an embodiment, a controller, such as controller 110, can be configured to receive a signal from an off-time detector 120. For example, a controller 110 can be configured to receive a measurement of the voltage across a capacitor 128 (Vc). Additionally and/or in the alternative, controller 110 can be configured to measure the voltage across a capacitor 128 (Vc). In an embodiment, controller 110 can be further configured to determine whether the ice maker has been unpowered a time period sufficient to begin ice production without overheating. For example, a controller 110 may receive a request to begin ice production, such as when an appliance 10 is first powered on or when a user input requests ice production to begin. A controller 110 can be configured to receive a signal from a capacitor 128 in off-time detector 120 indicative that the ice maker has been unpowered for the time period sufficient to begin ice production without overheating. For example, a controller 110 can receive a measurement of a voltage across the capacitor 128 (Vc). If controller 110 determines that substantially all charge in capacitor 128 has been discharged, controller 110 can send one or more control signals to an ice maker 50 to begin ice production. Alternatively, if controller 110 determines that a capacitor 128 has not discharged substantially all stored charge, controller 110 can determine that ice maker 50 has not been unpowered a sufficient time to begin ice production without overheating. For example, in an embodiment, controller 110 can be configured to wait a predetermined amount of time, such as, for example, three minutes, before sending one or more control signals to the ice maker 50 to begin ice production when the controller 110 determines that capacitor 128 has not discharged substantially all stored charge.

In another embodiment, controller 110 can be configured to send one or more control signals to the ice maker 50 to begin production when the controller receives a signal from the off-time detector indicative of the ice maker being unpowered for the time period sufficient to begin ice production without overheating. For example, when a controller 110 receives a request to begin ice production, a controller 110 can be configured to receive a signal from an off-time detector 120, such as a measurement of the voltage across a capacitor 128 (Vc). If controller 110 determines from the signal that ice maker has not been unpowered for the time period sufficient to begin ice production without overheating, such as, for example, if the measurement of the voltage across the capacitor 128 (Vc) indicates capacitor 128 has not discharged substantially all charge, controller 110 can be configured to periodically receive additional voltage measurements from an off-time detector 120 to determine when capacitor 128 has discharged substantially all stored charge. When controller 110 determines that capacitor 128 has discharged substantially all stored charge, controller 110 can send one or more control signals to ice maker 50 to begin ice production. In this way, a controller 110 can be configured to send one or more control signals to the ice maker to begin ice production based at least in part on a signal from the off-time detector indicative of the ice maker being unpowered for the time period sufficient to begin ice production without overheating.

Figure 7:
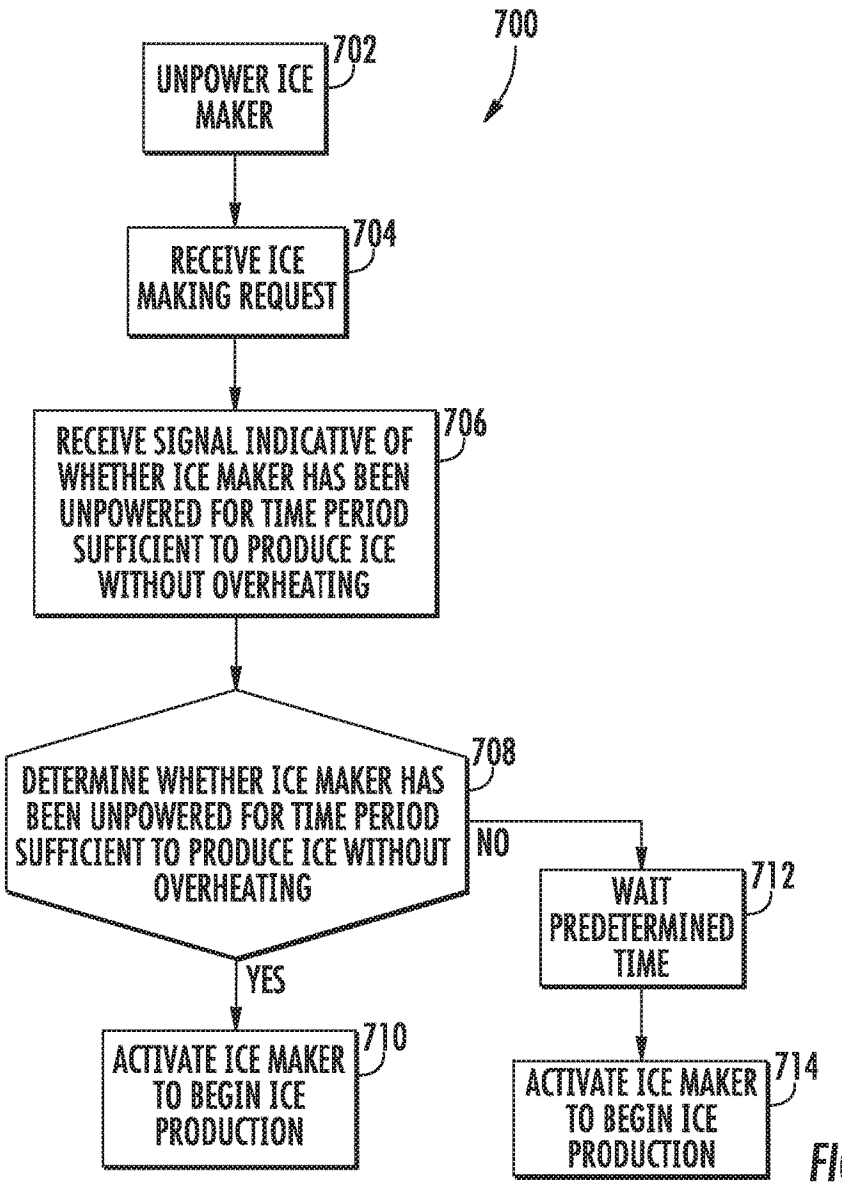
FIG. 7 depicts a flow diagram of an example method according to example embodiments of the present disclosure.

Referring now to FIG. 7, a flow diagram of an example method (700) according to example embodiments of the present disclosure is depicted. FIG. 7 can be implemented by one or more control devices, such as the control device 110 depicted in FIG. 5. In addition, FIG. 7 depicts steps performed in a particular order for purposes of illustration and discussion. Those of ordinary skill in the art, using the disclosures provided herein, will understand that the various steps of any of the methods disclosed herein can be modified, adapted, expanded, rearranged and/or omitted in various ways without deviating from the scope of the present disclosure.

At (702), the method can include unpowering an ice maker. For example, an ice maker 50 of an appliance 10 can be unpowered due to a consumer unplugging the appliance 10 from an electrical outlet, such as, for example, when the consumer wishes to move the appliance 10. Additionally, an ice maker 50 can be unpowered automatically due to a control scheme implemented by a controller, such as a controller 110, and/or from one or more user inputs.

At (704), the method can include receiving an ice making request. For example, a controller 110 can receive an ice making request from a user input. Additionally, a controller 110 may receive an ice making request when an appliance 110 is plugged into an electrical outlet. For example, a consumer may unpower an appliance 10 to relocate the appliance 10, and plug the appliance 10 into an electrical outlet shortly thereafter. The user may input a request to continue making ice, and/or the control scheme implemented by a controller, such as a controller 110, may automatically send a request to continue making ice.

At (706), the method can include receiving a signal indicative of whether the ice maker has been unpowered for a time period sufficient to produce ice without overheating. For example, an appliance 10 can have an ice maker 50, which can include a sealed system 80 with a compressor 82. The compressor 82 can be configured to begin ice production without overheating when it has been unpowered for a sufficient period of time, such as, for example, approximately three minutes. An off-time detector 120 can be configured to provide a signal indicative of whether the ice maker 50 has been unpowered for time period sufficient to begin ice production without overheating, such as, for example, approximately three minutes. For example, the off-time detector 120 can include a first resistor 126 and capacitor 128 connected in parallel, and a second resistor 132 connected in series with the first resistor 126 and capacitor 128 as shown in FIG. 6. The capacitor 128 can be charged when the ice maker 50 is powered and discharge stored charge through the first resistor 126 when the ice maker 50 is unpowered. The off-time detector 120 can be configured to provide a signal indicative of whether the ice maker 50 has been unpowered for a time period sufficient to begin ice production without overheating based at least upon a charge level of the capacitor 128 For example, a capacitor 128 can be configured to discharge substantially all charge stored in capacitor 128 after being unpowered for approximately three minutes. A controller, such as a controller 110, can be configured to receive a measurement of a voltage across the capacitor 128 (Vc).

At (708), the method can include determining whether the ice maker has been unpowered for a time period sufficient to produce ice without overheating. For example, a controller 110 can be configured to receive a measurement of a voltage across a capacitor 128 (Vc) in an off-time detector 120, and controller 110 can be configured to determine if the capacitor 128 has discharged substantially all charge.

If so, the controller 110 can determine that the ice maker 50 has been unpowered for a time period sufficient to begin ice production without overheating, and at (710) activate the ice making appliance to begin ice production by sending one or more control signals to ice maker 50 to begin ice production.

If not, at (712), the method can include waiting a predetermined time before beginning ice production. For example, if a controller 110 determines a capacitor 128 has not discharged substantially all charge, the controller 110 can wait a predetermined amount of time to allow an ice maker to cool down to a level sufficient to resume ice production, such as, for example, waiting approximately three minutes. Once the controller 110 has waited the predetermined time, the controller 110 at (714) can activate the appliance 10 to begin ice production by sending one or more control signals to the ice maker 50 to begin ice production.

Figure 8:
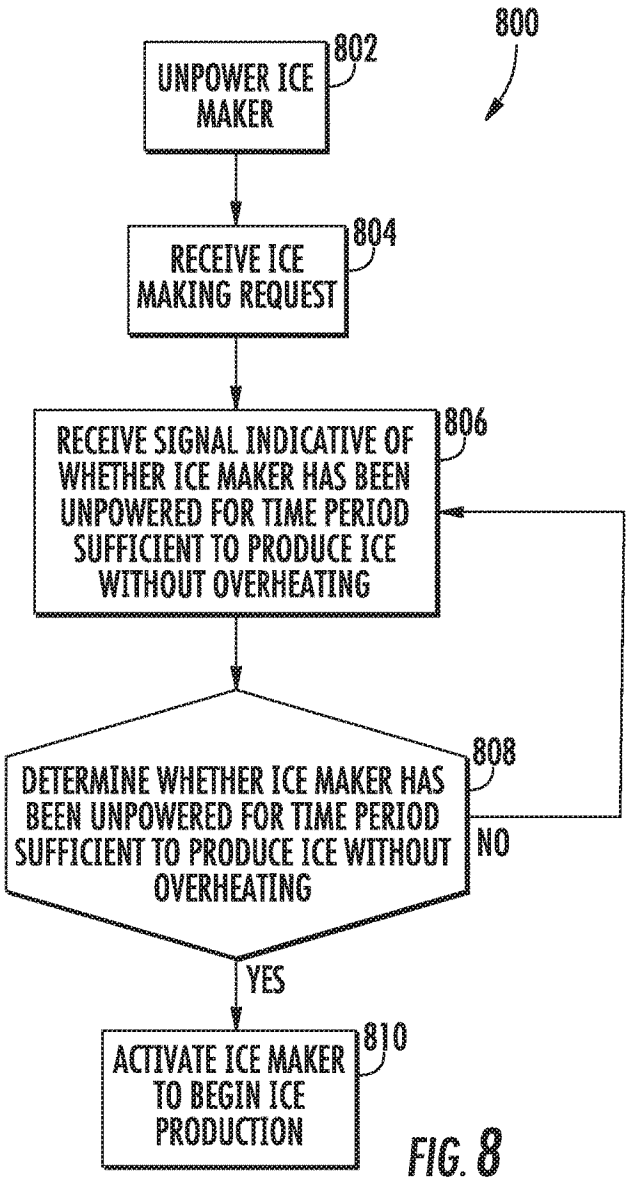
FIG. 8 depicts a flow diagram of an example method according to example embodiments of the present disclosure.

Referring now to FIG. 8, a flow diagram of an example method (800) according to example embodiments of the present disclosure is depicted. FIG. 8 can be implemented by one or more control devices, such as the control device 110 depicted in FIG. 5. In addition, FIG. 8 depicts steps performed in a particular order for purposes of illustration and discussion. Those of ordinary skill in the art, using the disclosures provided herein, will understand that the various steps of any of the methods disclosed herein can be modified, adapted, expanded, rearranged and/or omitted in various ways without deviating from the scope of the present disclosure. Steps 802, 804, and 806 are essentially identical to steps 702, 704, and 706 respectively discussed above, and no further discussion of these steps is included herein.

At (808), the method can include determining whether the ice maker has been unpowered for a time period sufficient to produce ice without overheating. For example, a controller 110 can be configured to receive a measurement of a voltage across a capacitor 128 (Vc) in an off-time detector 120, and controller 110 can be configured to determine if the capacitor 128 has discharged substantially all charge. If so, the controller 110 can determine that the ice maker 50 has been unpowered for a time period sufficient to begin ice production, and at (810) activate the ice making appliance to begin ice production by sending one or more control signals to ice maker 50 to begin ice production. If the controller 110 determines that the ice maker 50 has not been unpowered for the time period sufficient to begin ice production without overheating, such as, for example, if a capacitor 128 has not discharged substantially all charge, then controller 110 can be configured at (806) to receive another signal indicative of whether the ice maker 50 has been unpowered for a time period sufficient to produce ice without overheating. For example, a controller 110 can be configured to wait a period of time, such as, for example, 5 seconds, and receive a new measurement of the voltage across the capacitor 128 (Vc). Controller 110 can repeat steps (806) and (808) until controller 110 determines that the ice maker 50 has been unpowered for the time period sufficient to begin ice production, and at (810) activate the ice making appliance to begin ice production by sending one or more control signals to ice maker 50 to begin ice production.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:

a removable container disposed within an opening defined by an outer casing of the stand-alone ice making appliance, the removable container defining a first storage volume for receipt of ice;

a water tank, the water tank defining a second storage volume for receipt of water;

a pump in fluid communication with the second storage volume for actively flowing water from the water tank;

an ice maker, the ice maker in fluid communication with the pump for receiving water from the pump;

an off-time detector comprising a capacitor, wherein the off-time detector is configured to provide a signal indicative of a period of time during which the ice maker has been unpowered which is sufficient to begin ice production without overheating;

a controller configured to periodically receive one or more measurements indicative of a voltage across the capacitor and wherein the signal indicative of the period of time during which the ice maker has been unpowered is based on the one or more voltage measurements; and wherein the controller is further configured to generate a control signal based at least in part on the signal indicative of the period of time during which the ice maker has been unpowered and said control signal causes ice production to begin.

2. The stand-alone ice making appliance of claim 1, wherein the ice maker comprises a compressor, wherein the off-time detector is configured to provide the signal indicative of whether the compressor has been unpowered for the time period sufficient to begin ice production without overheating.

3. The stand-alone ice making appliance of claim 2, wherein the time period sufficient to begin ice production without overheating is less than three minutes after power is restored to the ice maker.

4. The stand-alone ice making appliance of claim 1, wherein the controller is further configured to wait a predetermined amount of time before sending the control signal to the ice maker to begin ice production when the controller receives the signal from the off-time detector indicative that the ice maker has not been unpowered for the time period sufficient to begin ice production without overheating.

5. The stand-alone ice making appliance of claim 1, wherein the off-time detector comprises a first resistor and the capacitor connected in parallel, and a second resistor connected in series with the first resistor and the capacitor, wherein the capacitor is charged when the ice maker is powered, and wherein the capacitor discharges stored charge through the first resistor when the ice maker is unpowered.

6. The stand-alone ice making appliance of claim 5, wherein the capacitor is configured to discharge substantially all stored charge in less than three minutes.

7. The stand-alone ice making appliance of claim 6, wherein the first resistor has a resistance of approximately 600 kiloohms, wherein the capacitor has a capacitance of approximately 180 microfarads, and wherein the second resistor has a resistance of approximately 100 ohms.

8. A stand-alone ice making appliance, comprising:

a removable container disposed within an opening defined by an outer casing of the stand-alone ice making appliance, the removable container defining a first storage volume for receipt of ice;

a water tank, the water tank defining a second storage volume for receipt of water and disposed below the container along a vertical direction;

a pump in fluid communication with the second storage volume for actively flowing water from the water tank;

a reservoir defining a third storage volume, the third storage volume in fluid communication with the pump for receiving water that is actively flowed from the water tank;

an ice maker, the ice maker comprising a sealed refrigeration system, the sealed refrigeration system comprising a compressor;

a chute extending between the ice maker and the container for directing ice produced by the ice maker towards the first storage volume;

an off-time detector comprising a capacitor, wherein the off-time detector is configured to provide a signal indicative of a period of time during which the ice maker has been unpowered which is sufficient to begin ice production without overheating, a controller configured to control the ice maker, the controller further configured to periodically receive one or more measurements indicative of a voltage across the capacitor and wherein the signal indicative of the period of time during which the ice maker has been unpowered is based on the one or more voltage measurements, and wherein the controller is further configured to generate a control signal based at least in part on the one or more voltage measurements and said control signal causes ice production to begin in a period of time that is less than three minutes after power is restored to the ice maker.

9. The stand-alone ice making appliance of claim 8, wherein the off-time detector comprises a first resistor and the capacitor connected in parallel and a second resistor connected in series with the first resistor and the capacitor, wherein the capacitor is charged when the ice maker is powered, wherein the capacitor discharges stored charge through the first resistor when the ice maker is unpowered.

10. The stand-alone ice making appliance of claim 9, wherein the controller is configured to activate the ice maker to begin ice production when the ice maker has been unpowered for the time period sufficient to begin ice production without overheating, wherein activating the ice maker comprises waiting a predetermined amount of time before sending the control signal to the ice maker to begin ice production when the capacitor has not discharged substantially all stored charge.

* * * * *